US007937916B2

(12) United States Patent
Thierig et al.

(10) Patent No.: US 7,937,916 B2
(45) Date of Patent: May 10, 2011

(54) APPARATUS FOR HANDLING TOBACCO BAGS

(75) Inventors: Jörg Thierig, Aystetten (DE); Jan-Erik Schneider, Diedorf (DE)

(73) Assignee: Focke & Co. (GmbH & Co. KG), Bremen (DE)

( * ) Notice: Subject to any disclaimer, the term of this patent is extended or adjusted under 35 U.S.C. 154(b) by 185 days.

(21) Appl. No.: 12/364,268

(22) Filed: Feb. 2, 2009

(65) Prior Publication Data

US 2009/0193762 A1 Aug. 6, 2009

(30) Foreign Application Priority Data

Feb. 5, 2008 (DE) ..... 10 2008 007 737

(51) Int. Cl.
*B65B 43/04* (2006.01)

(52) U.S. Cl. ..... 53/562; 53/386.1; 53/452; 53/455; 53/456

(58) Field of Classification Search ..... 53/386.1, 53/558, 570, 571, 562, 567, 568, 266.1, 452, 53/455, 456, 467, 473; 141/166; *B65B 43/50, B65B 043/18*

See application file for complete search history.

(56) References Cited

U.S. PATENT DOCUMENTS

| | | | | |
|---|---|---|---|---|
| 3,855,907 | A | 12/1974 | Johnson et al. | |
| 4,373,319 | A | 2/1983 | Pullen et al. | |
| 4,520,615 | A * | 6/1985 | Engler et al. | 53/550 |
| 4,726,170 | A * | 2/1988 | Sawa et al. | 53/570 |
| 4,941,309 | A * | 7/1990 | Fluent et al. | 53/544 |
| 5,209,042 | A * | 5/1993 | Rickard | 53/430 |
| 5,865,918 | A * | 2/1999 | Franklin et al. | 156/64 |
| 6,044,624 | A * | 4/2000 | Focke et al. | 53/438 |
| 6,499,280 | B1 | 12/2002 | Tsutsui | |
| 7,021,036 | B2 * | 4/2006 | Hiramoto et al. | 53/562 |

FOREIGN PATENT DOCUMENTS

| | | | |
|---|---|---|---|
| DE | 10 34 092 | B | 7/1958 |
| DE | 2059661 | A | 6/1972 |
| DE | 34 46 409 | A | 6/1986 |
| DE | 344 6409 | | 6/1986 |
| DE | 19 63 5700 | C1 | 9/1997 |
| DE | 1914 245 | | 10/1998 |
| EP | 0 673 835 | A1 | 9/1995 |
| EP | 1 145 959 | | 10/2001 |
| EP | 1447331 | A | 8/2004 |
| EP | 1 820 633 | A2 | 8/2007 |
| EP | 2014558 | A | 1/2009 |

OTHER PUBLICATIONS

European Search Report corresponding related European Application No. 09 00 0851 (May 13, 2009).

* cited by examiner

*Primary Examiner* — Thanh K Truong
(74) *Attorney, Agent, or Firm* — Laurence P. Colton; Smith Risley Tempel Santos LLC

(57) ABSTRACT

For the purpose of handling tobacco bags (10) made of sheet material, a plurality of unfilled bags (10) are fed to a transfer station (29) and transferred simultaneously, by a transfer subassembly (31), to a further-processing subassembly, namely to a bag turret (30) arranged above a bag conveyor (28). During transfer, the bags (10) are transported along an upwardly directed movement path and turned through 180° in the process.

18 Claims, 7 Drawing Sheets

*Fig. 10*
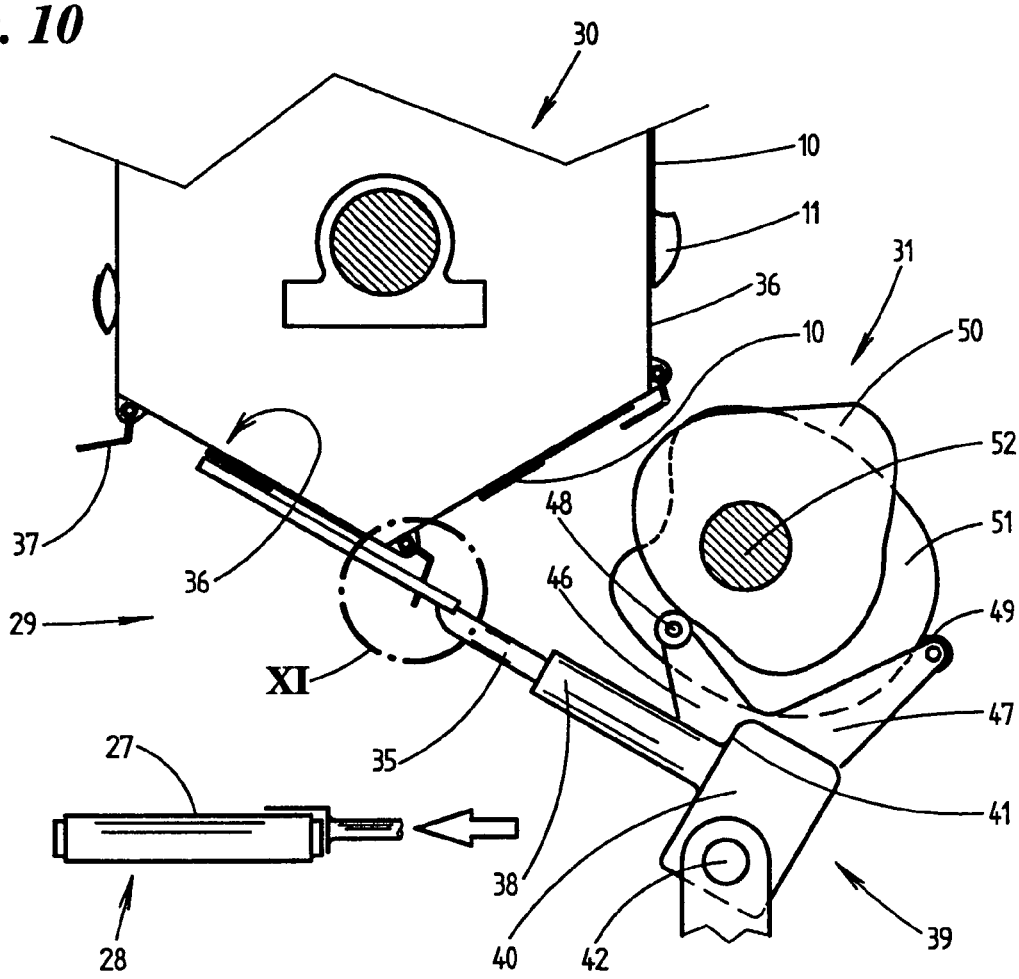
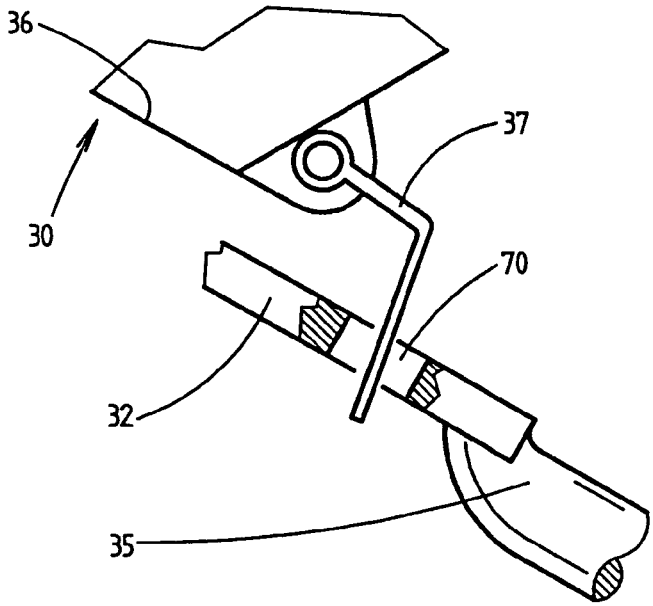
*Fig. 11*

APPARATUS FOR HANDLING TOBACCO BAGS

STATEMENT OF RELATED APPLICATIONS

This application claims the benefit under 35 USC 119 of German patent application number 10 2008 007 737.2 having a filing date of 5 Feb. 2008, which is incorporated herein in its entirety by this reference.

BACKGROUND OF THE INVENTION

1. Technical Field

Apparatus for handling blanks, namely for transferring them to a subassembly for processing the blanks further, in particular for transferring unfilled (sheet-material) bags or pouch bags for cut tobacco to a filling subassembly with holders for the bags, preferably to a (bag) turret.

2. Prior Art

In a known apparatus (DE 34 46 409 A), a continuous sheet-material web is transported horizontally in an upright plane, folded and divided up into individual bags by weld seams. These individual bags are severed one after the other from the web by transversely directed severing cuts and are transferred to a turret with a vertical axis of rotation and upright holders for in each case one bag. The bags are filled in the region of the turret.

BRIEF SUMMARY OF THE INVENTION

The invention concerns a sub-region of an arrangement for producing, filling and closing in particular (tobacco) bags. The object of the invention is to provide for improved high performance and reliable handling of the bags or other blanks, in particular during transfer to a turret.

In order to achieve this object, the apparatus according to the invention is characterized by the following features:

a) at least one bag (or some other blank) is held in a flat state on an underlying surface, in particular on a horizontal feed conveyor, b) the bag can be gripped essentially over the entire surface area of a free top side by an attachment gripper, in particular by a suction gripper, and can be removed by the latter from the underlying surface or the feed conveyor, and c) the bag gripped by the attachment gripper or suction gripper can be transported by the movable attachment gripper or suction gripper and deposited on the subassembly, in particular on the turret.

The concept of the invention is such that the finished, unfilled bags, that is to say bags lying in a flat state, preferably a group of spaced-apart bags lying next to one another, are held on a feed conveyor, designed as a suction belt, adjacent to a turret or some other subassembly for filling and closing the bags. These bags are gripped by means of suction air by way of planar or plate-like suction grippers assigned to each bag, and are raised up from the feed conveyor and, by virtue of corresponding rotary and tilting movements of the suction grippers, are fed to the turret or a holder on the turret in each case. During the transfer movement, the bags are turned, (along with the suction grippers) through 180°.

One special feature of the invention is an actuating mechanism which makes it possible for the suction grippers, with the bags, to execute complex, coinciding movements during transportation to the turret. The further special feature relates to the handling of adhesive-bonding strips, namely, in particular, tapes for closing the bags. According to the invention, the tapes, which are conventional in bags for tobacco, namely in particular fold-over bags, and are intended for fixing a fold-over flap, are applied in an appropriate position in the region of the continuous sheet-material web. Accordingly, the unfilled bags severed from the web have already been provided with the tape as they are transferred to the turret. The free side of the tape, which is provided with active adhesive, is protected, during transportation and preferably on the turret, against contamination, in particular against tobacco particles being deposited, with the aid of covering means.

BRIEF SUMMARY OF THE DRAWINGS

Further details of the invention relate to the gear mechanism for moving the suction grippers. Exemplary embodiments of the invention will be described more specifically hereinbelow, with reference to the drawings, in which:

FIGS. 8 to 10 show a projection, along with partial sections VIII-VIII from FIG. 6, with different movement phases of retaining or suction grippers with gear mechanism.

FIG. 11 shows, on an enlarged scale, a detail XI from FIG. 10.

DETAILED DESCRIPTION OF PREFERRED EMBODIMENTS

Figure 1:
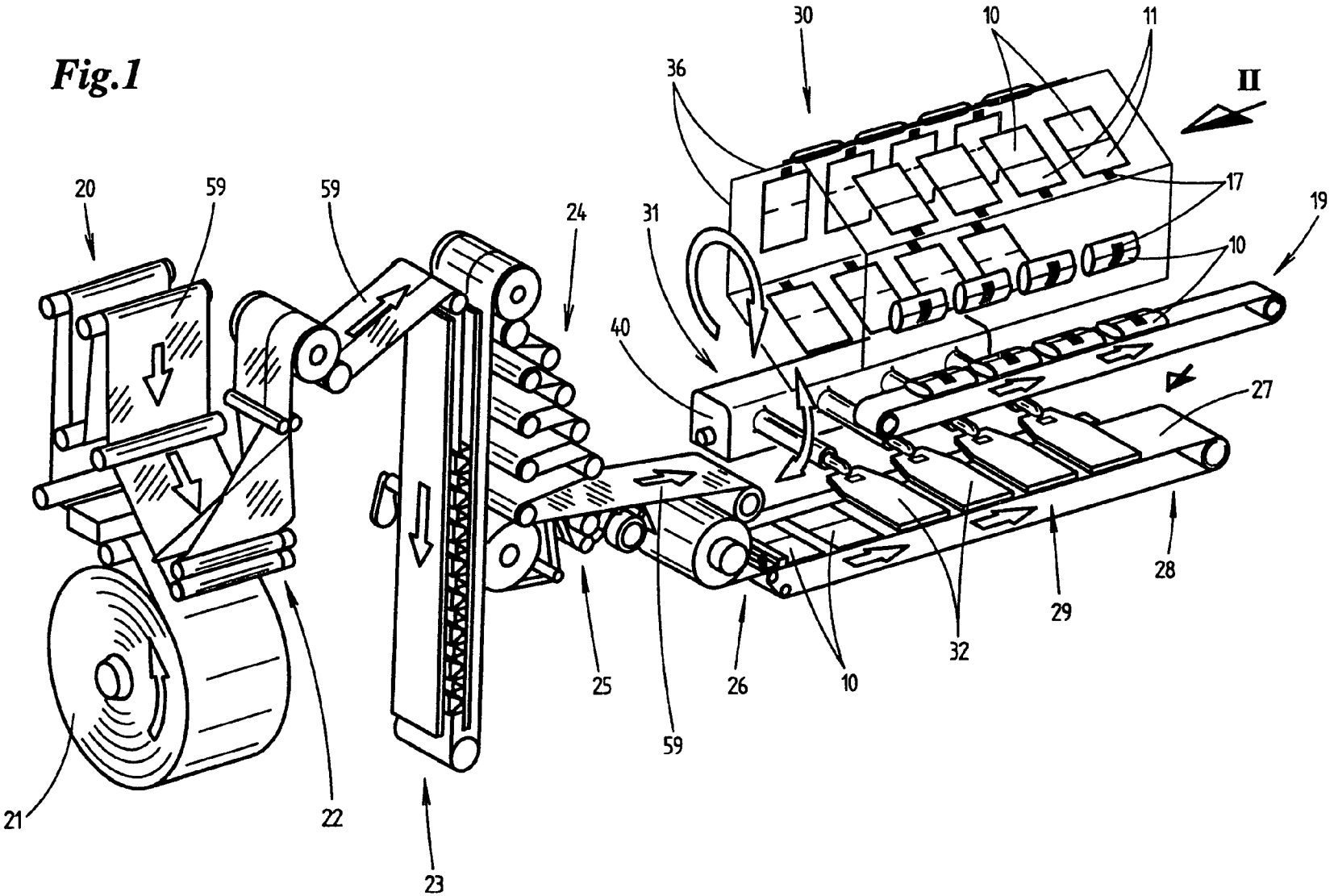
FIG. 1 shows a schematic illustration, in perspective, of an entire installation for producing and processing bags.
Figure 3:
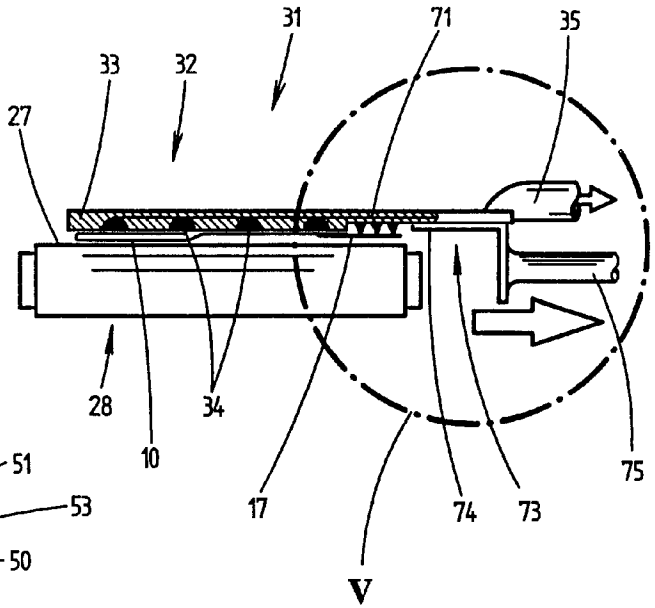
FIG. 3 shows on an enlarged scale, partially in section, a detail III from FIG. 2.
Figure 2:
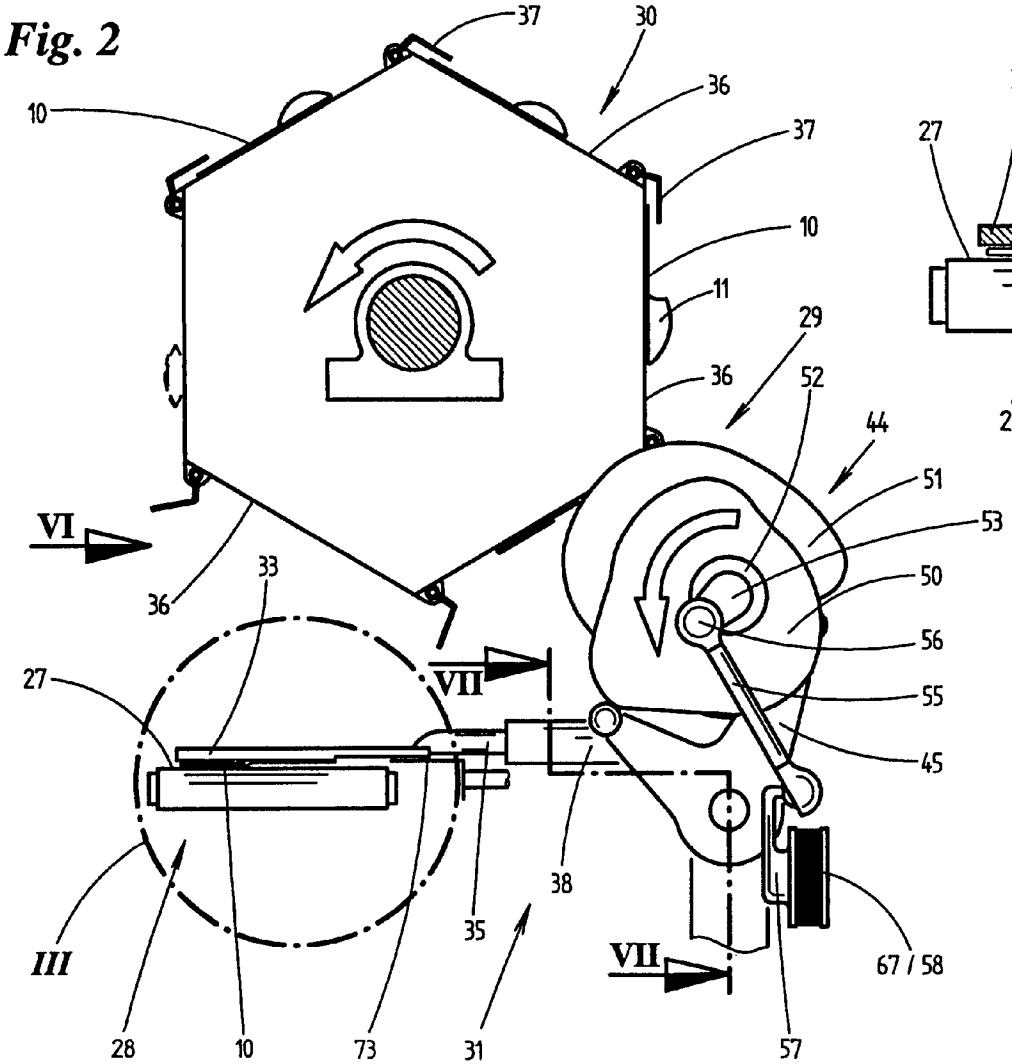
FIG. 2 shows a front view of the arrangement according to FIG. 1 as seen in the direction of arrow II.

The invention relates to the handling of unstable, sheet-like articles, in particular bags 10. The drawings concern the handling of such bags 10 made of sheet material, namely tobacco bags for accommodating a portion of cut tobacco. Each bag 10 comprises an elongate, rectangular blank which is made of sheet material and, by virtue of being folded over, forms a pocket 11 for accommodating the bag content. The front wall 13 and rear wall 14 of the pocket 11 are connected to one another by side seams 12. An extension of the rear wall 14 forms a closure flap or fold-over flap 15. An opening 16 of the pocket 11 is preferably closed by a closure seam (not shown). The fold-over flap 15 is folded around the (filled) pocket 11 and fixed on the front wall 13 by means of an adhesive-bonding closure strip, namely tape 17. The tape 17 is provided with a self-adhesive coating directed towards the bag 10, and has a non-adhesive grip tab 18 at the free end.

An arrangement which is illustrated schematically in FIG. 1 serves for producing the bags 10, for filling the pockets 11, for closing the bags 10 and for completing the same. The bags 10, once ready for shipping, are removed one after the other by a removal conveyor 19.

A continuous sheet-material web 59 is drawn off continuously from a reel 21 in the region of a sheet-material station 20 and guided through a folding subassembly 22. In the region of the latter, a leg of the sheet-material web 59 is folded over to form the pocket 11. The sheet-material web 59 prepared in this way passes into a sealing subassembly 23. The folded sheet-material web 59 is transported through the latter in a conveying direction which runs from top to bottom, and transversely directed sealing seams are provided by sealing devices, during a brief standstill phase, in order to form the side seams 12.

Following the sealing subassembly 23, the sheet-material web runs through a compensating device, namely a conventional web pendulum mechanism 24. This is followed by a tape subassembly 25. The latter applies tapes 17 to the continuous sheet-material web 59, to be precise in a position associated with a respective bag 10. The closure strips or tapes 17 are applied accordingly to the sheet-material web. This is followed by severing station 26 for severing the bags 10 from the sheet-material web 59 by transversely directed severing cuts in the region of the correspondingly formed double-width sealing seams. The resulting completed bags 10 are deposited on an underlying surface, in this case on a horizontal top strand 27 of a bag conveyor 28.

The bag conveyor 28 transports the bags 10 into a transfer station 29, in which the bags 10 are removed from the top strand 27 and fed to a filling and closing subassembly, namely to a bag turret 30. In the region of the latter, the bags 10 run through a plurality of stations for filling, for closing and folding over the bags 10. The transfer station 29 is designed such that a plurality of bags 10 located one beside the other on the bag conveyor 28, in the present case four equally spaced-apart bags 10, are gripped simultaneously in an operating cycle and transferred to the bag turret 30. Accordingly, the bag conveyor 28 can be moved cyclically, to be precise by a movement cycle which corresponds to the number of bags 10 supplied. The bag conveyor 28 is designed as a suction belt with a suction device or suction box 77 beneath the top strand 27 at least in the region where the bags 10 are supplied for transfer to the bag turret 30. The negative pressure in the region of the top strand 27 is expediently switched off in order for the bags 10 to be removed.

The arrangement according to FIG. 1 is distinguished by a compact construction with a clearly laid-out, that is to say L-shaped or U-shaped transporting path from the sheet-material web 59 at the start to the bag turret 30.

One special feature is a transfer subassembly 31 from the supply plane, that is to say the bag conveyor 28, to the processing subassembly, that is to say to the bag turret 30. The subassembly 31 has movable devices for gripping a respective bag 10, for raising the latter up from the bag conveyor 28 and for transferring the bags 10 to the bag turret 30. The (four) bags 10, which form a group, are simultaneously gripped, transported and transferred. Accordingly, a number of correspondingly designed retaining devices which corresponds to the number of bags 10 which are to be gripped are fitted on the transfer subassembly 31. These devices are designed as suction grippers 32 with plate-like suction heads 33, which each grip a bag 10 on the free top side by means of suction air. The suction heads 33 are designed and/or dimensioned such that the bag 10 lying in a flat state is gripped essentially over its entire surface area. The suction head 33 is provided, on the side directed towards the bags 10, with a number of suction bores or—as in the case of the exemplary embodiment illustrated—with elastic suckers 34, which come into abutment against the free surface of the bag 10, and grip the latter by suction attachment of the sheet material. The suckers 34 are connected to a negative-pressure source (not shown) via suction channels 76 in the suction head 33. The suction channels 76 of the suction head 33 each lead to a suction tube 35. The suckers 34 are distributed such that the unstable bag 10 is gripped to a sufficient extent. Accordingly, suckers 34 are fitted at least in corner regions and distributed over the region of the plate-like suction head 33. The bag 10 is gripped in the region of the upwardly directed front wall 13 of the pocket 11 and in the region of the fold-over flap 15.

The bag turret 30 is positioned directly adjacent to the bag conveyor 28 or to the top strand 27, to be precise above the bag conveyor 28. The bags 10 can thus be transferred by means of an upwardly directed pivoting movement of the suction grippers 32. The holders provided for the bags 10 on the bag turret 30 are planar abutment surfaces 36, which are designed and dimensioned so as to accommodate the number of bags 10 supplied (four) one beside the other on an abutment surface 36. On account of a corresponding cross section of the bag turret 30, the abutment surfaces 36 are arranged in a polygonal manner, the abutment surface 36 which accommodates the new bags 10 in each case being located in a bottom region of the bag turret 30 and being directed at an acute angle to an (imaginary) horizontal plane.

For transfer to the bag turret 30, the bag 10 is transported along an angular conveying section and during this time turned through 180°. At the moment of abutment against the abutment surface 36, the bag 10 is directed upwards on account of a corresponding rotary movement of the suction gripper 32. Accordingly, the bag 10 is transferred to the bag turret 30 such that the pocket 11 has its front wall 13 directed outwards, or towards the free side, and follows the fold-over flap 15 in the movement direction of the bag turret 30. This means that, in a station with an upright abutment surface 36, the bag 10 is in a position in which it is possible to fill the pocket 11 with the opening 16 directed upwards.

The bag turret 30 is preferably designed in accordance with DE 10 2007 053 854.7, that is to say with mechanical and/or pneumatic retaining means for fixing the bag 10 on the respective abutment surface 36.

The suction gripper 32 executes—along with the bag 10—coinciding lifting and turning movements. For this purpose, the suction gripper 32 is fitted on a carrying arm 38. In the case of the present exemplary embodiment, the suction tube 35 is part of the carrying arm 38 and/or is connected thereto. The suction gripper 32 is moved by an actuating unit 39 which has a carrier on which the suction head or the suction heads 33 is or are fitted, in the present case via the carrying arms 38.

The complex movement of the grippers 32 is brought about by independent gear mechanisms which are coordinated with one another, in particular by a common drive or a drive connection. The tilting movement of the carrying devices for the bags 10, that is to say of the suction grippers 32, is brought about by a corresponding movement of a carrier. The latter, in this case, is designed as an elongate, rectangular housing 40 which can be pivoted back and forth about a transversely directed axis. The (four) carrying arms 38 are fastened on the carrier or housing 40 in the region of a side wall. The housing 40, as carrier of the lifting heads 33, is fitted on a stationary carrying framework such that it can be pivoted by way of lateral bearings 42. A bearing pin is formed on the one side of the drive shaft 43 for the tilting movements of the housing 40. The controlled pivoting movements of the carrier or housing 40 are transmitted to the drive shaft 43 by a special gear mechanism, namely by a cam-controlled crank mechanism 44.

An actuating device acting like a crank arm, namely an approximately V-shaped roller carrier 45, is fitted at the end of the drive shaft 43. Contact rollers 48, 49 are mounted at the ends of fork-like spread-apart retaining arms 46, 47 and interact with the rotatable cam device. The latter is formed by two cam plates 50, 51 which are spaced apart from one another on a common shaft and have the contact rollers 48, 49 running along their outer contour. A common rotary movement of the cam plates 50, 51 transmits a back and forth pivoting movement to the drive shaft 43 and thus to the housing 40, as carrier of the suction grippers 32, to be precise causes the same to be pivoted from the receiving position in the region of the bag conveyer 28 into a position in which the bags 10 butt against an abutment surface 36 of the bag turret 30.

The cam plates 50, 51 are driven continuously in a rotation. The cam plates 50, 51 are spaced apart axially from one another on a common shaft 52. The latter is connected to a (machine) drive for the purpose of transmitting the rotary movement.

The shaft 52 also serves for driving a second gear mechanism, which causes the devices for retaining the bags 10, or the carrying arms 38, to rotate. This gear mechanism is connected to a crank arm 53 at the end of the shaft 52. The crank arm 53, in turn, transmits movements to a linkage 54. The latter has a connecting rod 55 which is connected, via a (ball-and-socket) joint 56, to a pin fitted on the crank arm 53. The movement of the connecting rod 55 is transmitted, via a jointed connection, to a crank arm 57 which causes a drive wheel 58, as part of the second gear mechanism, which will be described hereinbelow, to rotate back and forth.

The second gear mechanism causes the devices for retaining the bags 10, or the carrying arms 38, to rotate. These carrying arms are designed in a special manner, mainly as hollow bodies or tubes. The carrying arms 38 accommodate within them rotatable carrying devices, namely shaft components 60, which can be rotated within the carrying arm 38 and are connected to the suction head 33, for example via the suction tube 35. The latter, as an extension within the carrying arm 38, may form the shaft component 60.

The shaft components 60 of the (four) suction heads 33 can be rotated back and forth, to be precise through 180° in each case, by a drive within the housing 40. For this purpose, drive wheels or gearwheels 61 are fitted at the ends of the shaft components 60. These drive wheels or gearwheels, in turn, can be rotated by a drive means. In the case of the present example, all (four) gearwheels 61 are driven, to be precise back and forth, by a common toothed belt 62. The toothed belt 62 is likewise accommodated predominantly within the housing 40 and is guided via deflecting wheels 63, designed as gearwheels, and via deflecting rollers 64 such that the toothed belt 62 forms a sufficient wrap-around angle for each gearwheel 61.

In order for drive power to be transmitted to the toothed belt 62, the latter is directed out of the housing 40 in the region of an opening 65 and guided, via deflecting devices, to the circumference of a drive wheel 66. The latter is designed as a gearwheel and is driven in co-ordination with the mechanism 44. In the case of the present exemplary embodiment, a separate belt drive with a toothed belt 67 serves as a drive for the wheel 66. The toothed belt 67, which runs outside the housing 40, is connected to the drive wheel 58, which also causes the mechanism 44 to be driven. The arrangement is such that deflecting rollers 68 assigned to the drive wheel 66 are mounted in a fixed (but rotatable) manner. That part of the toothed belt 62 which runs within the housing 40 follows the tilting or pivoting movements of the housing 40, the toothed belt 62 twisting in the region of a horizontal (bottom) strand 69.

A further special feature is the handling of the bags 10, with tape 17 applied thereto, by the suction gripper 32. The suction head 33 is provided with an extension 71 extending beyond the abutment region of the bag 10 or of the fold-over flap 15. The tape 17 is located in the region of this extension. Accordingly, the relative positioning of the bag 10 on the bag conveyor 28 is predetermined such that the bags are positioned with the fold-over flap 15 or the tape 17 oriented in the direction of the bag turret 30. The upwardly directed, glue-coated side of the tape 17 butts against supporting devices of the suction head 33, namely against a plurality of abutment components 72 which taper to a point. These components have the downwardly directed points (or sharp edges) butting against the glue surface of the tape 17. During the transfer of the bag 10 to the bag turret 30, the suckers 34 are switched over to admit air or compressed air. The bag 10 is thus freed from the suction head 33. The tape 17 can easily be released from the abutment component 72 without any additional aids being required.

Figure 4:
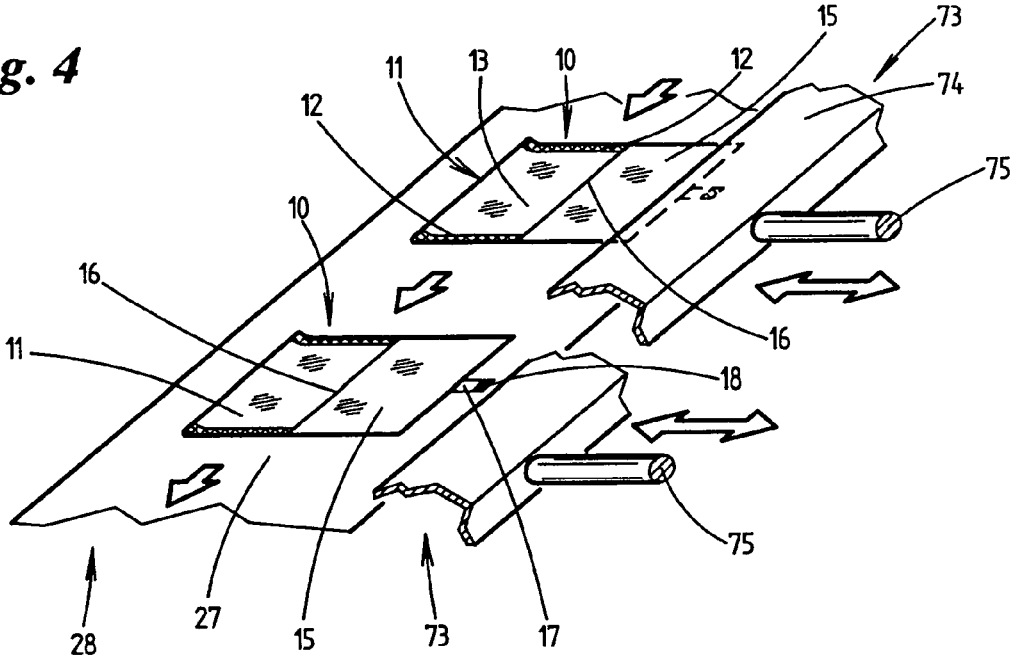
FIG. 4 shows a perspective illustration of a sub-region of a feed conveyor for individual bags.
Figure 5:
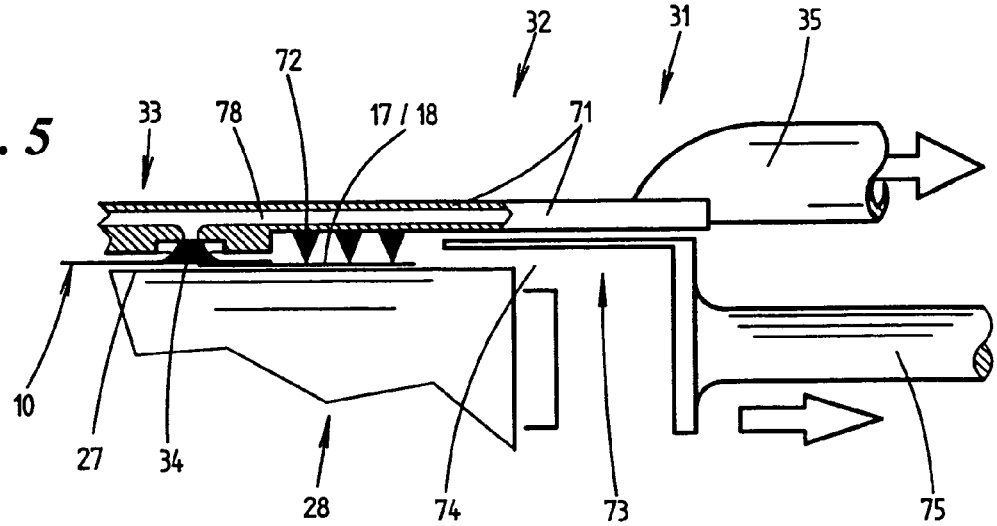
FIG. 5 shows, on a further-enlarged scale, a part V of the detail according to FIG. 3.
Figure 6:
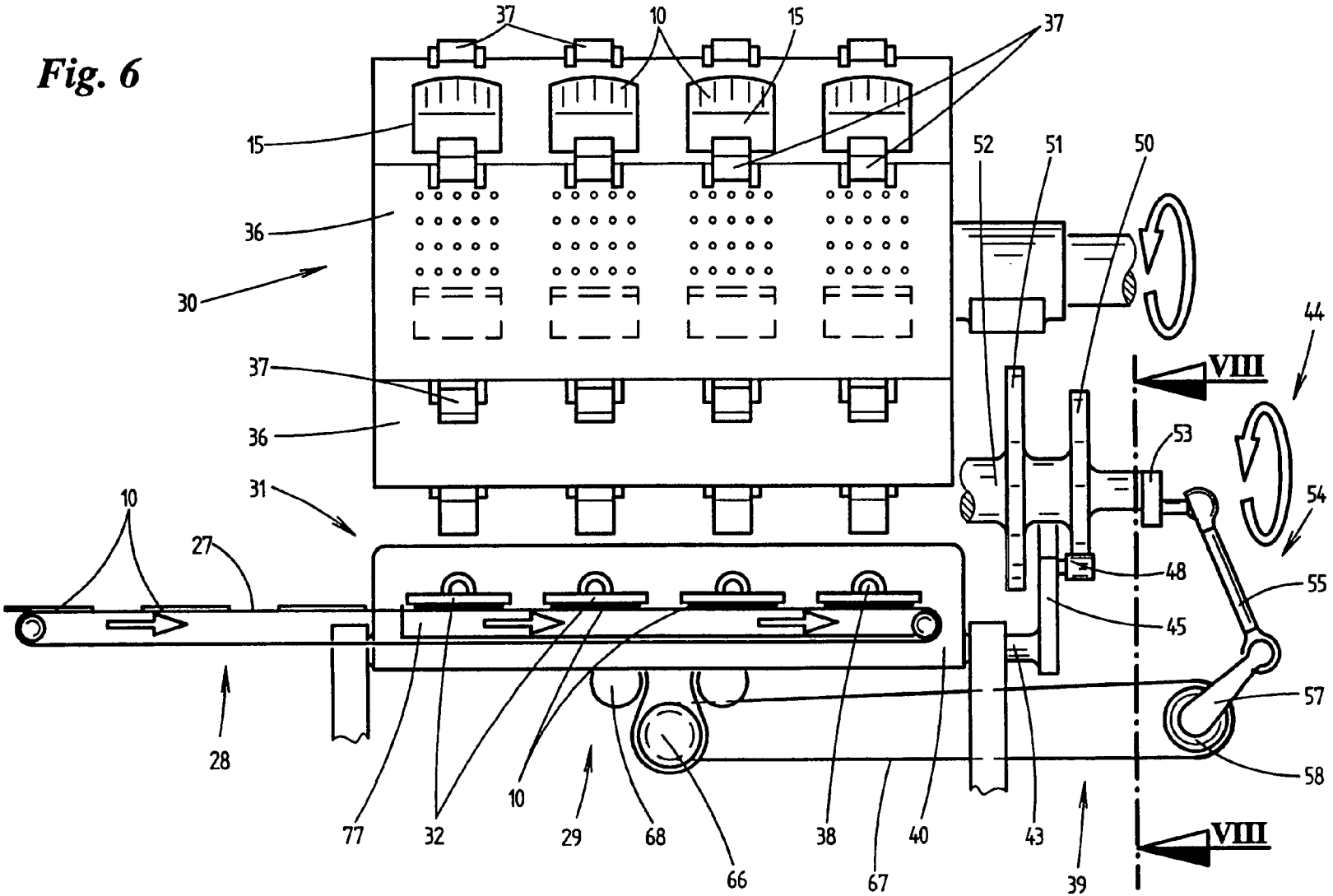
FIG. 6 shows a side view of the apparatus for handling bags as seen in the direction of arrow VI in FIG. 2.
Figure 7:
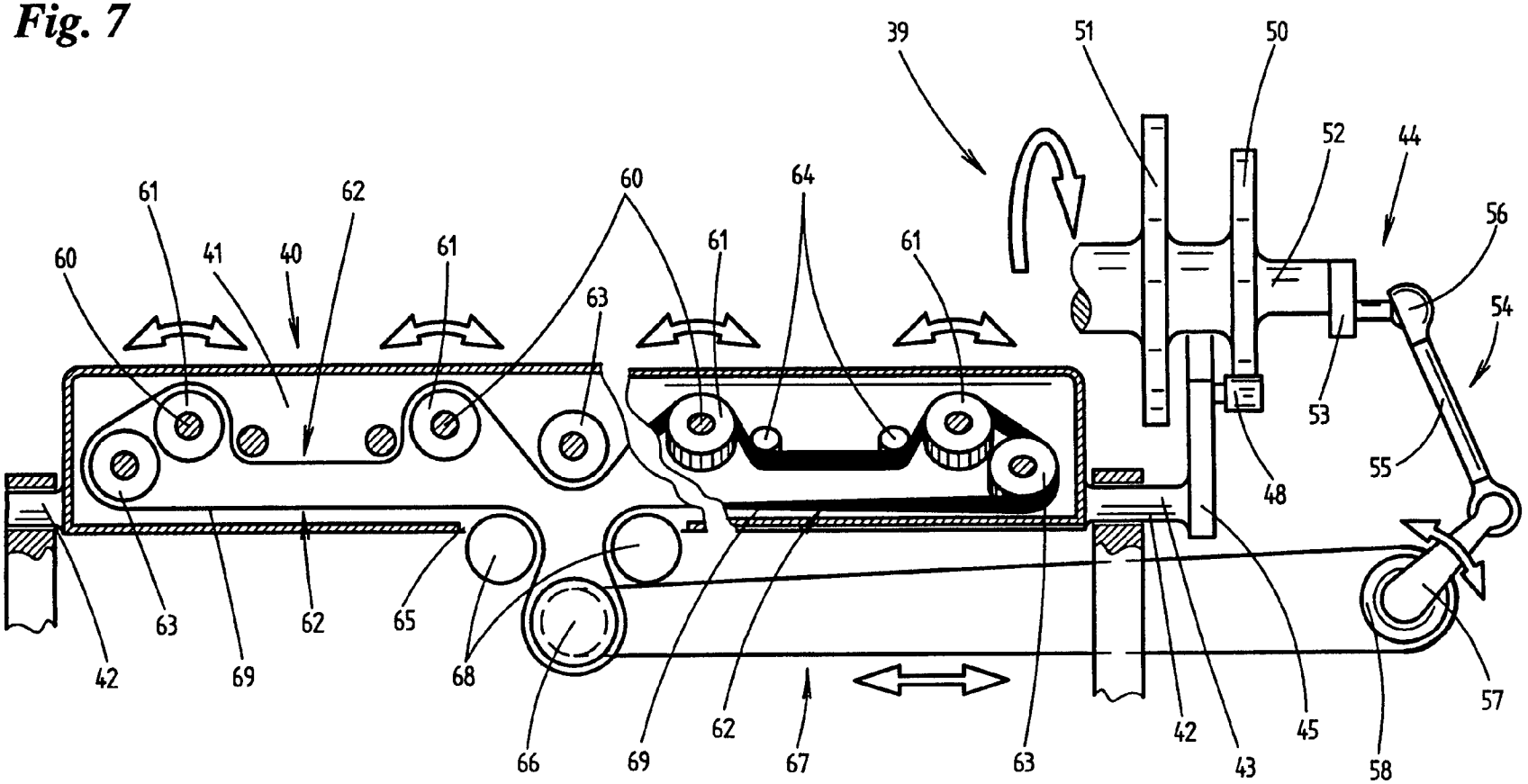
FIG. 7 shows a gear mechanism for actuating gripping devices in projection and in longitudinal section along section plane VII-VII from FIG. 2.
Figure 8:
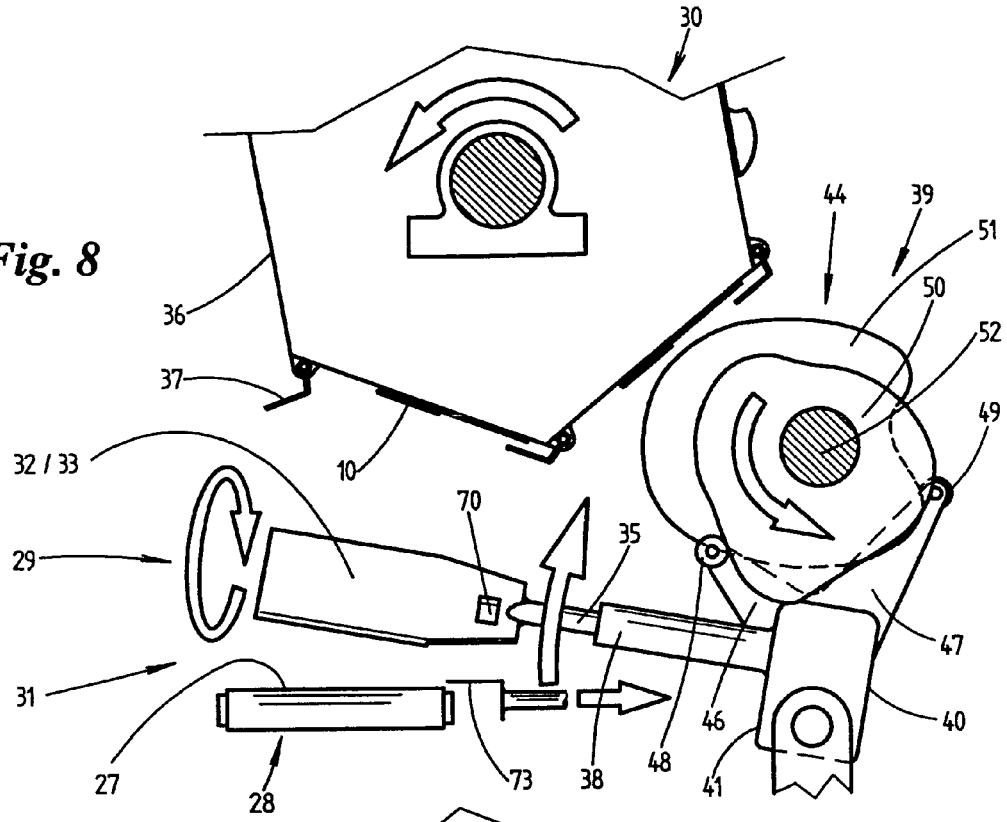
Figure 9:
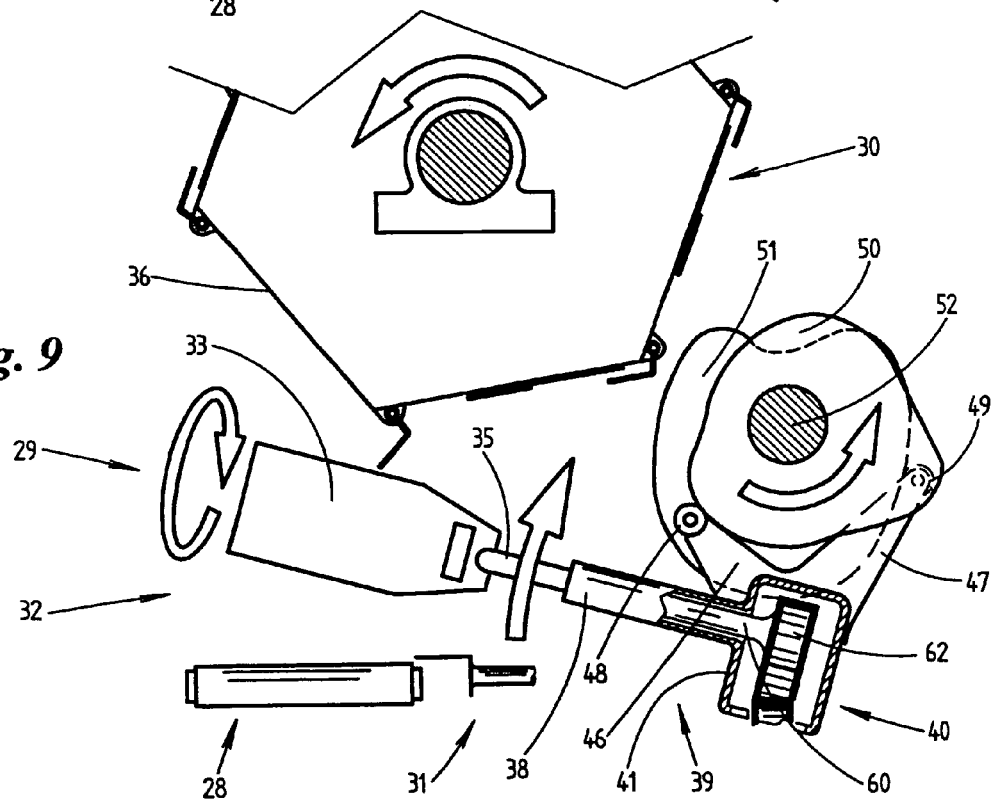

During handling of the bags 10, the free, upwardly directed side of the tape 17 with active adhesive thereon is protected by corresponding devices, to be precise by movable covering devices, against particles, in particular tobacco particles, being deposited. A covering means for the tapes 17 is fitted in the region of the top strand 27 of the bag conveyor 28, at least in the region of the transfer station 29. The covering device is a covering profile or a covering rail 73 which is angular in cross section. The top, essentially horizontally directed leg 74 of the latter serves as covering means and, in the covering position (FIG. 4, on the right), is located above the tape 17 or at least the free end region. The covering rail 73 is mounted such that the leg 74, as covering device, is positioned in a contact-free manner above the tape 17. In order for the bag 10 (with tape 17) to be received by a suction head 33, the covering rail 73 is moved out of the covering position, that is to say is retracted via a push rod 75.

The suction gripper 32, or the suction head 33 thereof is designed in the region of action of the covering rail 73, that is to say is provided with a set-back portion, such that the leg 74 of the covering rail 73 can be moved in a horizontal plane, that is to say by the push rod 75, at a distance above the plane of the tape 17.

It is also the case in the region of the bag turret 30 that a covering protects the tape 17, or the free, adhesive-coated endpiece of the same, against particles being deposited thereon. This covering is a movable, namely pivotable, covering lever 37 on the bag turret 30. Accordingly, each abutment surface 36 of the bag turret 30 is assigned covering levers 37, in the present case in each case four adjacent covering levers 37 for each abutment surface 36.

In order that the bags 10 can be transferred to the bag turret 30 from the suction heads 33 with the covering lever 37 moved back, the suction head 33 is provided with an aperture 70 for the through-passage of the covering lever 37 in the retracted position (FIG. 11). It is also the case that the covering levers 37 or a covering leg of the same are/is spaced apart from, that is to say free of contact with, the adhesive-bonding surface of the tape 17.

LIST OF DESIGNATIONS

| | |
|---|---|
| 10 | Bag |
| 11 | Pocket |
| 12 | Side seam |
| 13 | Front wall |
| 14 | Rear wall |
| 15 | Fold-over flap |
| 16 | Opening |
| 17 | Tape |
| 18 | Grip tab |
| 19 | Removal conveyor |
| 20 | Sheet-material station |
| 21 | Reel |
| 22 | Folding subassembly |

-continued

| | |
|---|---|
| 23 | Sealing subassembly |
| 24 | Web pendulum mechanism |
| 25 | Tape subassembly |
| 26 | Severing station |
| 27 | Top strand |
| 28 | Bag conveyor |
| 29 | Transfer station |
| 30 | Bag turret |
| 31 | Transfer subassembly |
| 32 | Suction gripper |
| 33 | Suction head |
| 34 | Sucker |
| 35 | Suction tube |
| 36 | Abutment surface |
| 37 | Covering lever |
| 38 | Carrying arm |
| 39 | Actuating unit |
| 40 | Housing |
| 41 | Side wall |
| 42 | Bearing |
| 43 | Drive shaft |
| 44 | Crank mechanism |
| 45 | Roller carrier |
| 46 | Retaining arm |
| 47 | Retaining arm |
| 48 | Contact roller |
| 49 | Contact roller |
| 50 | Cam plate |
| 51 | Cam plate |
| 52 | Shaft |
| 53 | Crank arm |
| 54 | Linkage |
| 55 | Connecting rod |
| 56 | Joint |
| 57 | Crank arm |
| 58 | Drive wheel |
| 59 | Sheet-material web |
| 60 | Shaft component |
| 61 | Gearwheel |
| 62 | Toothed belt |
| 63 | Deflecting wheel |
| 64 | Deflecting roller |
| 65 | Opening |
| 66 | Drive wheel |
| 67 | Toothed belt |
| 68 | Deflecting roller |
| 69 | Strand |
| 70 | Aperture |
| 71 | Extension |
| 72 | Abutment component |
| 73 | Covering rail |
| 74 | Leg |
| 75 | Push rod |
| 76 | Suction channel |
| 77 | Suction box |

What is claimed is:

1. An apparatus for transferring unfilled bags (10) for cut tobacco to a bag turret (30) filling subassembly with holders for a respective bag, comprising:

a) a horizontal feed bag conveyor (28) for holding at least one bag (10) in a flat state on an underlying surface, b) an attachment gripper for gripping the bag (10) on the surface area of a free top side of the bag (10), the attachment gripper being a suction gripper (32), and c) a suction head (33), wherein the bag (10) is removed by the suction gripper (32) from the underlying surface or the bag conveyor (28), the bag (10) gripped by the suction gripper (32) is transported by the suction gripper (32) and transferred to the bag turret (30), the bag (10) has a pocket (11), a front pocket wall (13) and a closure flap (15) and is held on the underlying surface or the bag conveyor (28) with the front pocket wall (13) exposed and directed upwards, and the bag (10) is gripped on the surface area in the region of the front pocket wall (13), and of an inner side of the closure flap (15) that adjoins the front pocket wall (13), by the suction head (33).

2. The apparatus according to claim 1, wherein a plurality of the bags (10) are held one beside the other on the underlying surface or a top strand (27) of the bag conveyor (28), the bag conveyor (28) being a suction conveyor, in order to be received simultaneously by the suction head (33) that is assigned to each of the bags (10), and the bags (10) are transferred in this way to the bag turret (30).

3. The apparatus according to claim 1, wherein the bag turret (30) has a direction of rotation that runs transversely to the conveying direction of the bags (10) into the transfer station (29), which is transverse to the conveying direction of the bag conveyor (28).

4. The apparatus according to claim 1, wherein the bag conveyor (28), or a top strand (27) thereof, runs beneath the bag turret (30) such that four of the bags (10) supplied for a transfer to the bag turret (30) are located directly beneath an obliquely directed abutment surface (36) of the bag turret (30) such that, by virtue of an exclusively upwardly directed pivoting movement of the suction grippers (32), the bags (10) are transferred simultaneously to the associated abutment surface (36).

5. The apparatus according to claim 4, wherein the obliquely directed abutment surface (36) of the bag turret (30) is positioned such that, by virtue of the upwardly directed pivoting movement, the suction gripper (32), or the suction head (33) thereof, is moved out of a horizontal receiving position into a transfer position, in which it is directed obliquely in a manner corresponding to the abutment surface (36).

6. The apparatus according to claim 1, wherein four of the suction heads (33) are arranged on a common carrier, the common carrier being an elongate housing (40) which is pivoted back and forth about an axis, which is directed transversely to the suction heads (33), such that the suction heads (33) are moved out of a horizontal receiving position into an obliquely directed transfer position.

7. The apparatus according to claim 6, further comprising a crank mechanism (44) and a drive shaft (43), the crank mechanism (44) having constantly revolving cam plates (50, 51) as control devices that act on a crank arm or roller carrier (45) that is fitted on the drive shaft (43) and that are pivoted back and forth, wherein the pivoting movements of the carrier or of the housing (40) are executed by the crank mechanism (44) which acts on the drive shaft (43), which is fitted on the carrier or the housing (40).

8. The apparatus according to claim 7, wherein the cam plates (50, 51) are mounted on a shaft (52) which, as a main shaft, is connected to a machine drive, the shaft (52) driving the crank mechanism (44) with linkage (54) by means of a crank arm (53).

9. The apparatus according to claim 1, wherein the suction heads (33) are driven in rotation by a gear mechanism, wherein shaft components (60) are arranged on the suction heads (33) and have fitted on them drive gearwheels (61), which are moved in rotation by a common toothed belt (62).

10. The apparatus according to claim 9, wherein the gearwheels (61) are arranged at ends of the shaft components (60) within the housing (40) and the toothed belt (62), which is common to all the suction grippers (32) and/or to all the shaft components (60), is guided within the housing (40), and a drive for the toothed belt (62) is arranged outside the housing (40).

11. An apparatus for transferring unfilled bags (10) for cut tobacco to a bag turret (30) filling subassembly with holders for a respective bag, comprising:

a) a horizontal feed bag conveyor (28) for holding at least one bag (10) in a flat state on an underlying surface, and b) an attachment gripper for gripping the bag (10) on the surface area of a free top side of the bag (10), the attachment gripper being a suction gripper (32), wherein the bag (10) is removed by the suction gripper (32) from the underlying surface or the bag conveyor (28), the bag (10) gripped by the suction gripper (32) is transported by the suction gripper (32) and transferred to the bag turret (30), and the suction gripper (32) with the bag (10) are rotated through 180° during a transfer movement from the bag conveyor (28) to the bag turret (30) such that that a side of the bag (10) which is originally directed towards the bag conveyor (28) is directed towards the bag turret (30) or an abutment surface (36) of the same.

12. An apparatus for transferring unfilled bags (10) for cut tobacco to a bag turret (30) filling subassembly with holders for a respective bag, comprising:

a) a horizontal feed bag conveyor (28) for holding at least one bag (10) in a flat state on an underlying surface, and b) an attachment gripper for gripping the bag (10) on the surface area of a free top side of the bag (10), the attachment gripper being a suction gripper (32), wherein the bag (10) is removed by the suction gripper (32) from the underlying surface or the bag conveyor (28), the bag (10) gripped by the suction gripper (32) is transported by the suction gripper (32) and transferred to the bag turret (30), and the suction grippers (32) have plate-like suction heads (33) which each grip the bag (10) on the free top side by means of suction bores or by means of elastic suckers (34), the suction bores or the elastic suckers (34) being distributed over the free surface of a bag (10).

13. An apparatus for transferring unfilled bags (10) for cut tobacco to a bag turret (30) filling subassembly with holders for a respective bag, comprising:

a) a horizontal feed bag conveyor (28) for holding at least one bag (10) in a flat state on an underlying surface, and b) an attachment gripper for gripping the bag (10) on the surface area of a free top side of the bag (10), the attachment gripper being a suction gripper (32), wherein:

the bag (10) is removed by the suction gripper (32) from the underlying surface or the bag conveyor (28), the bag (10) gripped by the suction gripper (32) is transported by the suction gripper (32) and transferred to the bag turret (30), the bag (10) is arranged on the bag conveyor (28) with tape (17) applied to the closure flap (15), a glue-coated end region of the tape (17) being exposed, the suction gripper (32) comprises plate-like suction heads (33) having an extension (71) which extends into the region of the exposed tape (17), and in the region of the extension (71), the suction heads (33) have pointed or sharp-edged abutment components (72) into which the tape (17) butts at least by way of an open glue surface.

14. The apparatus according to claim 13, further comprising covering devices arranged in the region of the bag turret (30), the covering devices being pivotable covering levers (37) for the tape (17) arranged on the bag (10), or for the free glue surface of the tape (17).

15. An apparatus for transferring unfilled bags (10) for cut tobacco to a bag turret (30) filling subassembly with holders for a respective bag, comprising:

a) a horizontal feed bag conveyor (28) for holding at least one bag (10) in a flat state on an underlying surface, and b) an attachment gripper for gripping the bag (10) on the surface area of a free top side of the bag (10), the attachment gripper being a suction gripper (32), wherein:

the bag (10) is removed by the suction gripper (32) from the underlying surface or the bag conveyor (28), the bag (10) gripped by the suction gripper (32) is transported by the suction gripper (32) and transferred to the bag turret (30), the bag (10) has an adhesive-bonding strip or a tape (17) which has an exposed upwardly oriented glue surface, in the region of the bag conveyor (28), and a protective covering rail (73) is provided in the region of the bag conveyor (28), at least in the region of a transfer station (29) for transferring the bag (10) to a downstream subassembly, whereby the covering rail (73) provides a protective covering for the tapes (17), or for the glue surfaces of the same, the covering rail (73) being mounted laterally alongside the bag conveyor (28) or the top strand (27) and covers, at least temporarily, a peripheral region of the closure flap (15), including tape (17), in a contact-free manner with a leg (74) spaced apart from the top side of the tapes (17).

16. An apparatus for transferring unfilled bags (10) for cut tobacco to a bag turret (30) filling subassembly with holders for a respective bag, comprising:

a) a horizontal feed bag conveyor (28) for holding at least one bag (10) in a flat state on an underlying surface, b) an attachment gripper for gripping the bag (10) on the surface area of a free top side of the bag (10), the attachment gripper being a suction gripper (32), wherein the bag (10) is removed by the suction gripper (32) from the underlying surface or the bag conveyor (28), the bag (10) gripped by the suction gripper (32) is transported by the suction gripper (32) and transferred to the bag turret (30), and the suction gripper (32) executes an upwardly directed pivoting movement and, at the same time, a rotary movement through 180° such that, at the end of the transfer movement, the suction heads (33), each with the bag (10), are arranged in an oblique position and turned through 180° in a manner corresponding to the position or abutment surface (36) of a holder for the bag (10) on the bag turret (30).

17. The apparatus according to claim 16, wherein the suction gripper (32), or suction heads (33) thereof, are moved by two different gear mechanisms which are coordinated with one another in respect of movement and have a common drive.

18. The apparatus according to claim 17, wherein a first of the two gear mechanisms is for pivoting movements of a common carrier of the suction gripper (32), thus pivoting movements of the suction gripper (32), and a second of the two gear mechanisms is for the rotary movement of the suction gripper (32), the two gear mechanisms being connected to the common drive and are driven by main shaft (52), wherein the first gear mechanism is a crank mechanism (44) that is driven by a shaft (52) and is connected in drive terms to a deflecting or drive wheel (58) for a toothed belt (62) via a crank arm (57) that can be moved back and forth.

* * * * *